US010006472B2

(12) United States Patent
Nishikawa et al.

(10) Patent No.: US 10,006,472 B2
(45) Date of Patent: Jun. 26, 2018

(54) CONSTRUCTION MACHINE

(71) Applicants: HITACHI CONSTRUCTION MACHINERY CO., LTD., Tokyo (JP); Takako Satake, Ishioka (JP)

(72) Inventors: Shinji Nishikawa, Kasumigaura (JP); Hidetoshi Satake, Ishioka (JP); Shinya Imura, Toride (JP); Shiho Izumi, Hitachinaka (JP); Kouji Ishikawa, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 622 days.

(21) Appl. No.: 14/431,482

(22) PCT Filed: Oct. 15, 2013

(86) PCT No.: PCT/JP2013/077990
§ 371 (c)(1),
(2) Date: Mar. 26, 2015

(87) PCT Pub. No.: WO2014/073337
PCT Pub. Date: May 15, 2014

(65) Prior Publication Data

US 2015/0219123 A1 Aug. 6, 2015

(30) Foreign Application Priority Data

Nov. 8, 2012 (JP) ..... 2012-246632

(51) Int. Cl.
*F15B 11/04* (2006.01)
*E02F 9/12* (2006.01)
(Continued)

(52) U.S. Cl.
CPC ..... *F15B 11/04* (2013.01); *E02F 9/123* (2013.01); *E02F 9/20* (2013.01); *E02F 9/2095* (2013.01);
(Continued)

(58) Field of Classification Search
CPC ..... F15B 11/162; F15B 2211/30565; F15B 2211/3057; E02F 9/2095
(Continued)

(56) References Cited

U.S. PATENT DOCUMENTS 4,207,740 A * 6/1980 Ripa ..... E02F 3/42 137/596.13
8,958,958 B2 * 2/2015 Imura ..... E02F 9/123 180/53.1
(Continued)

FOREIGN PATENT DOCUMENTS

CN 101305136 A 11/2008
EP 2620555 A1 7/2013
(Continued)

OTHER PUBLICATIONS

International Report on Patentability received in corresponding International Application No. PCT/JP2013/077990 dated May 21, 2015.
(Continued)

*Primary Examiner* — Michael Leslie
*Assistant Examiner* — Matthew Wiblin
(74) *Attorney, Agent, or Firm* — Mattingly & Malur, PC

(57) ABSTRACT

A construction machine includes: a swing structure (50); a hydraulic pump (1); a hydraulic motor (3) for driving the swing structure (50) using hydraulic fluid from the hydraulic pump (1); an electric motor (14) for driving the swing structure (50) with or without the aid of the hydraulic motor (3); and a hydraulic actuator (16) driven by the hydraulic
(Continued)

fluid from the hydraulic pump 1, the hydraulic actuator can be operated together with the swing structure (50). When the swing structure (50) is operated together with the hydraulic actuator (16), only the electric motor (14) is used to swing the swing structure (50).

4 Claims, 7 Drawing Sheets

(51) Int. Cl.

| | |
|---|---|
| ***E02F 9/20*** | (2006.01) |
| ***E02F 9/22*** | (2006.01) |
| ***F15B 11/16*** | (2006.01) |
| ***F15B 13/06*** | (2006.01) |
| ***F15B 13/14*** | (2006.01) |
| *F15B 15/20* | (2006.01) |

(52) U.S. Cl.
CPC ..... *E02F 9/22* (2013.01); *E02F 9/2203* (2013.01); *E02F 9/2217* (2013.01); *E02F 9/2282* (2013.01); *E02F 9/2285* (2013.01); *E02F 9/2296* (2013.01); *F15B 11/162* (2013.01); *F15B 11/165* (2013.01); *F15B 13/06* (2013.01); *F15B 13/14* (2013.01); *F15B 2015/206* (2013.01); *F15B 2211/205* (2013.01); *F15B 2211/20515* (2013.01); *F15B 2211/7058* (2013.01); *F15B 2211/7135* (2013.01); *F15B 2211/75* (2013.01); *F15B 2211/781* (2013.01)

(58) Field of Classification Search
USPC ..... 91/455, 457
See application file for complete search history.

(56) References Cited

U.S. PATENT DOCUMENTS

| | | | | |
|---|---|---|---|---|
| 2008/0072588 | A1* | 3/2008 | Ariga | E02F 9/2235 60/449 |
| 2008/0082240 | A1 | 4/2008 | Kagoshima et al. | |
| 2008/0264051 | A1 | 10/2008 | Ericson et al. | |
| 2010/0242464 | A1* | 9/2010 | Vigholm | E02F 9/2228 60/327 |
| 2013/0058750 | A1* | 3/2013 | Hiroki | E02F 9/123 414/744.2 |
| 2013/0195597 | A1* | 8/2013 | Imura | E02F 9/123 414/744.2 |
| 2014/0165548 | A1* | 6/2014 | Satake | E02F 9/2075 60/420 |

FOREIGN PATENT DOCUMENTS

| | | | | | |
|---|---|---|---|---|---|
| JP | 2002-310102 | A | | 10/2002 | |
| JP | 2008-88659 | A | | 4/2008 | |
| JP | 2011-241653 | A | | 12/2011 | |
| JP | 2011241653 | A | * | 12/2011 | E02F 9/123 |
| JP | 2012-162861 | A | | 8/2012 | |
| WO | 2012/039083 | A1 | | 3/2012 | |
| WO | WO 2012039083 | A1 | * | 3/2012 | E02F 9/123 |
| WO | 2012/105279 | A1 | | 8/2012 | |
| WO | WO 2012157510 | A1 | * | 11/2012 | E02F 9/2075 |

OTHER PUBLICATIONS

Chinese Office Action received in corresponding Chinese Application No. 201380057760.X dated Jul. 5, 2016.

* cited by examiner

PRIOR ART

CONSTRUCTION MACHINE

TECHNICAL FIELD

The present invention relates to construction machines having both a hydraulic motor and an electric motor for driving a swing structure.

BACKGROUND ART

A construction machine such as a hydraulic excavator or the like often includes a hydraulic pump driven by an engine; hydraulic actuators driven by the hydraulic fluid supplied from the hydraulic pump; and a swing structure. Such a machine now comes in hybrid form. In a hybrid construction machine, an electric motor is used to control the operation and braking of the swing structure, and the kinetic energy of the swing structure at the time of stopping its swing motion is regenerated as electric energy. The electric energy regenerated is fed to the electric motor to drive the swing structure, thereby reducing the power of the hydraulic pump (i.e., reducing the engine load). This in turn reduces the amount of fuel consumed by the engine, leading to energy saving.

JP-2011-241653-A discloses a hybrid construction machine that has both a hydraulic motor and an electric motor as swing motors to swing its swing structure (i.e., hybrid swing motion is achieved). In such a machine, the hydraulic swing motor and other hydraulic actuators (hydraulic cylinders) are typically disposed along the same hydraulic circuit, and the hydraulic fluid suctioned by a single hydraulic pump is used to drive each of those. In this respect, the above construction machine is structurally the same as conventional construction machines in which only the hydraulic motor is used to drive the swing structure.

PRIOR ART DOCUMENTS

Patent Documents

Patent Document 1: JP-2011-241653-A

SUMMARY OF THE INVENTION

Problems to be Solved by the Invention

In such a system as above in which the hydraulic swing motor and other hydraulic actuators receive hydraulic fluid from a single hydraulic pump, when the hydraulic swing motor is operated together with another hydraulic actuator by an operator, more of the hydraulic fluid flows into the actuator with the smaller load. Thus, if the load on the hydraulic swing motor is smaller, more of the hydraulic fluid flows into it, resulting in the acceleration of the swing structure. This also deteriorates the maneuvering feelings of the operator. Especially, when both of the hydraulic swing motor and the electric swing motor are used to drive the swing structure as above, the load on the hydraulic swing motor tends to be smaller than in conventional construction machines, meaning more hydraulic fluid flows into the hydraulic swing motor.

Such a system as described above, in which the hydraulic swing motor and other hydraulic actuators receive hydraulic fluid from a single pump, includes a boom cylinder if the construction machine is an excavator. In this case, if a boom raising operation is performed during a swing operation and a larger load is exerted on the boom cylinder than on the hydraulic motor (e.g., when a load is lifted during a low-speed swing operation), the start of the boom raising operation increases the pump pressure, causing the high-pressure hydraulic fluid to flow into the hydraulic swing motor on which a smaller load is exerted. This in turn accelerates the swing structure. For instance, assume that an operator is trying to accurately move a load to a target position while performing a low-speed swing operation. If the operator further performs a boom raising operation, the swing structure will be accelerated, forcing the operator to perform operations different from those usually performed when the swing structure is not accelerated so much. Thus, it becomes difficult for him to stop the load accurately at the target position.

An object of the present invention is thus to allow a construction machine having both a hydraulic motor and an electric motor for driving a swing structure to offer good maneuvering feelings even when a swing operation is performed together with another actuator operation.

Means for Solving the Problems (1) To achieve the above object, the present invention provides a construction machine comprising: a swing structure; a hydraulic pump; a hydraulic motor for driving the swing structure using hydraulic fluid from the hydraulic pump; an electric motor for driving the swing structure with or without the aid of the hydraulic motor; and a hydraulic actuator driven by the hydraulic fluid from the hydraulic pump, the hydraulic actuator can be operated together with the swing structure, wherein only the electric motor is used to swing the swing structure when the swing structure is operated together with the hydraulic actuator.

(2) In the above construction machine (1), the hydraulic fluid supply from the hydraulic pump to the hydraulic motor is preferably cut off when the swing structure is operated together with the hydraulic actuator.

(3) The above construction machine (2) further comprises: a directional control valve, installed in a hydraulic line connecting the hydraulic pump and the hydraulic motor, for controlling the direction and flow rate of the hydraulic fluid supplied from the hydraulic pump to the hydraulic motor; and a shut-off valve installed in the hydraulic line connecting the hydraulic pump and the directional control valve, wherein the shut-off valve is placed in a closed position when the swing structure is operated together with the hydraulic actuator.

(4) The above construction machine (2) further comprises: a directional control valve, installed in a hydraulic line connecting the hydraulic pump and the hydraulic motor, for controlling the direction and flow rate of the hydraulic fluid supplied from the hydraulic pump to the hydraulic motor; and shut-off valves installed in hydraulic lines connecting the directional control valve and the hydraulic motor, wherein the shut-off valves are placed in a closed position when the swing structure is operated together with the hydraulic actuator.

(5) The above construction machine (2) further comprises: a directional control valve for, installed in a hydraulic line connecting the hydraulic pump and the hydraulic motor, for controlling the direction and flow rate of the hydraulic fluid supplied from the hydraulic pump to the hydraulic motor; and blocking devices for blocking a control signal acting on the directional control valve when the swing structure is operated together with the hydraulic actuator.

Effect of the Invention

The invention allows a construction machine having both a hydraulic motor and an electric motor for driving a swing structure to offer good maneuvering feelings even when a swing operation is performed together with another actuator operation.

MODE FOR CARRYING OUT THE INVENTION

Embodiments of the present invention will now be described with reference to the accompanying drawings. In the embodiments, the invention is applied to hydraulic excavators. The invention can be applied to construction machines in general as long as they have an upper swing structure and both a hydraulic swing motor and an electric swing motor to drive the upper swing structure. It should be noted that the application of the invention is not limited to the crawler-type hydraulic excavator described below; it can also be applied to other construction machines such as wheel-type hydraulic excavators, cranes, and the like.

Figure 1:
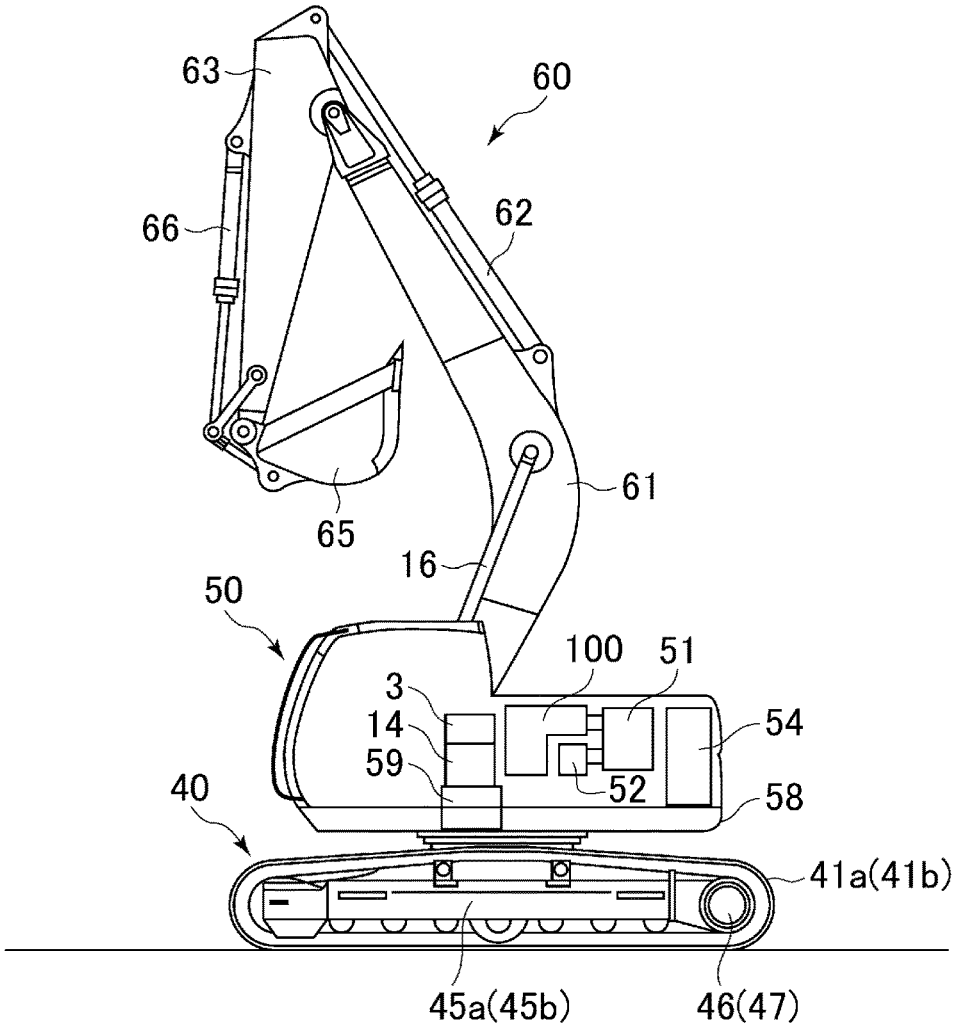
FIG. 1 is a side view of a hybrid hydraulic excavator according to an embodiment of the invention.

FIG. 1 is a side view of a hybrid hydraulic excavator according to an embodiment of the invention. As illustrated, the hybrid hydraulic excavator includes a lower travel structure 40, an upper swing structure 50, and a front work device 60.

The lower travel structure 40 includes the following components: a pair of crawler belts 41*a* and 41*b* (only the belt 41*a* being illustrated); a pair of crawler frames 45*a* and 45*b* (only the frame 45*a* being illustrated); a pair of hydraulic travel motors 46 and 47 for independently controlling the operation of the crawler belts 41*a* and 41*b*, respectively; and associated decelerating mechanisms.

The upper swing structure 50 includes the following components: an engine 51 (i.e., the prime mover); an assistive power-generating motor 52; a hydraulic pump 1 (see FIG. 2); a hydraulic swing motor 3; an electric swing motor 14; a capacitor 54; a decelerating mechanism 59; and a swing frame 58 on which to mount these components.

The assistive power-generating motor 52 is mechanically coupled to the engine 51 and assists the engine 51 when electric power is left in the capacitor 54. If not, the engine 51 drives the assistive power-generating motor 52 to generate electric power. The hydraulic pump 1 is mechanically connected to the engine 51 and draws hydraulic fluid from a tank 4 (see FIG. 2) to deliver it to each hydraulic actuator.

The hydraulic swing motor 3 and the electric swing motor 14 constitute the drive source for the upper swing structure 50 and are used to swing the upper swing structure 50 via the decelerating mechanism 59. The hydraulic swing motor 3 swings the upper swing structure 50 using the hydraulic fluid from the hydraulic pump 1, while the electric swing motor 14 swings the upper swing structure 50 using the electric power from the capacitor 54 or from the assistive power-generating motor 52. The way the hydraulic swing motor 3 and the electric swing motor 14 are used to drive the upper swing structure 50 (e.g., which motor should be used, 3 or 14, or whether both of the motors 3 and 14 should be used) is determined in accordance with the status of other hydraulic actuators, the power left in the capacitor 54, and so on. The drive force of the electric swing motor 14 and hydraulic swing motor 3 is transmitted through the decelerating mechanism 59, and it causes the upper swing structure 50 (the swing frame 58) to swing relative to the lower travel structure 40.

The capacitor 54 is used to supply electric power to the assistive power-generating motor 52 and the electric swing motor 14 and store the electric power generated by these motors 52 and 14. An example of the capacitor 54 is an electric double-layer capacitor.

The front work device 60 (i.e., an excavating mechanism) is attached to a front section of the upper swing structure 50. The front work device 60 includes the following components: a boom 61; a boom cylinder 16 for driving the boom 61; an arm 63 attached rotatably to the distal end of the boom 61; an arm cylinder 62 for driving the arm 63; a bucket 65 attached rotatably to the distal end of the arm 63; and a bucket cylinder 66 for driving the bucket 65.

A hydraulic system 100 is also mounted on the swing frame 58 of the upper swing structure 50. This hydraulic system 100 is used to drive various hydraulic actuators such as the hydraulic travel motors 46 and 47, the hydraulic swing motor 3, the boom cylinder 16, the arm cylinder 62, and the bucket cylinder 66.

Figure 2:
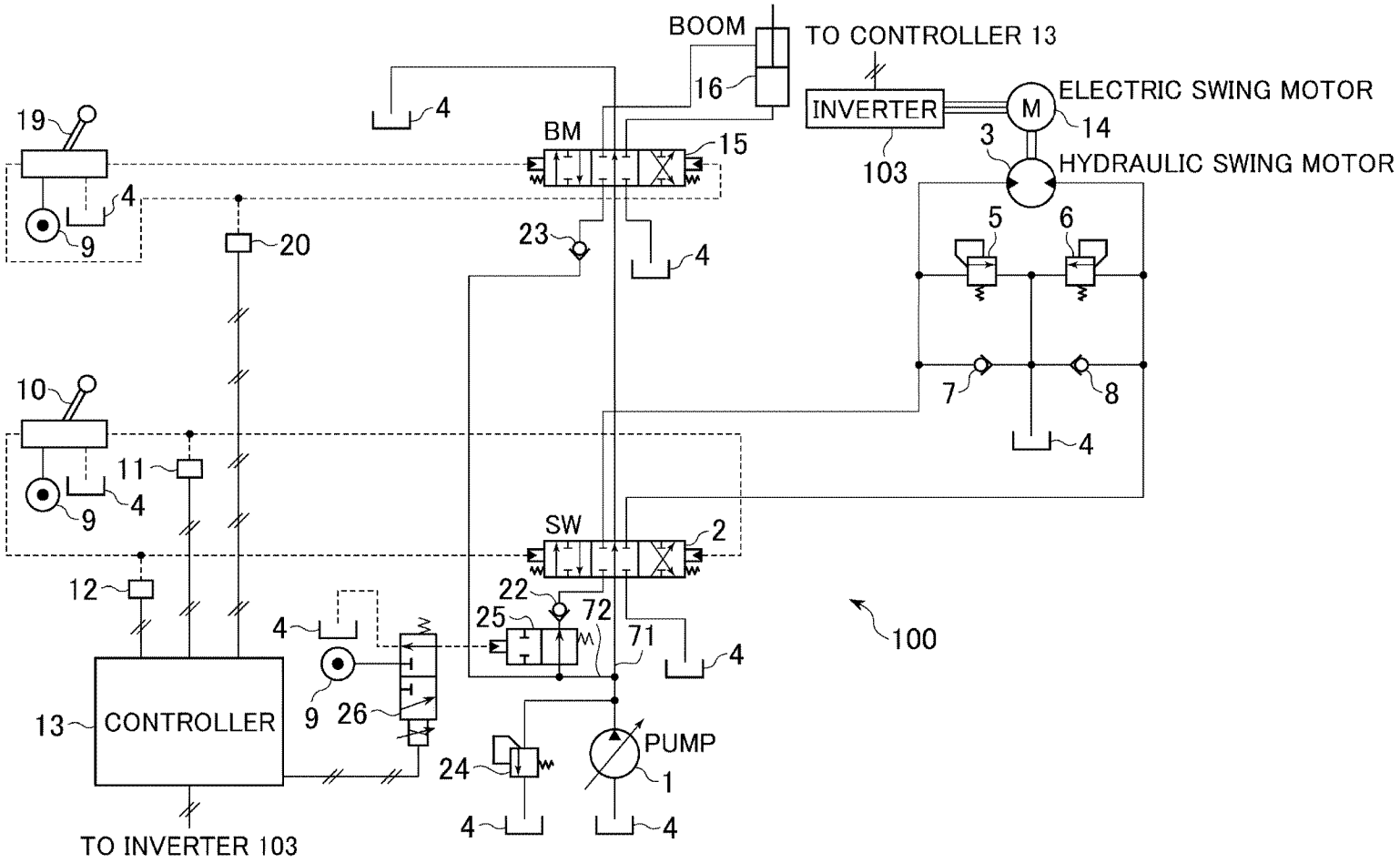
FIG. 2 is a schematic illustrating the overall structure of a hydraulic system 100 according to Embodiment 1 of the invention.

FIG. 2 is a schematic illustrating the overall structure of an open-center hydraulic system 100 according to Embodiment 1 of the invention. The explanation that follows is based on the assumptions that: the hydraulic actuator that operates simultaneously with the upper swing structure 50 is the boom cylinder 16; and a load is lifted with the use of a hook or the like attached near the joint section between the arm and the bucket. Thus, among all the directional control valves used for controlling the hydraulic actuators installed in the hydraulic excavator of FIG. 1, FIG. 2 illustrates only directional control valves 2 and 15 used for controlling the hydraulic swing motor 14 and the boom cylinder 16, respectively. It should also be noted that in FIG. 2, the same components as used in FIG. 1 are assigned the same reference numerals and will not be discussed further in detail (the same applies to the drawings referred to later).

The hydraulic system of FIG. 2 includes the following components: the directional control valve 2 for controlling the direction and flow rate of the hydraulic fluid supplied to the hydraulic swing motor 3; the directional control valve 15 for controlling the direction and flow rate of the hydraulic fluid supplied to the boom cylinder 16; a shut-off valve 25; a solenoid valve 26; a control lever 10 (operating device) for outputting a pressure control signal (pilot pressure) to control the swing motion of the upper swing structure 50; a control lever 19 (operating device) for outputting a pressure control signal (pilot pressure) to control the rotation (or the expansion and contraction) of the boom 61; a controller 13 (control system) for controlling the entire operation of the hydraulic excavator (including the operation of the electric swing motor 14, the solenoid valve 26, and the like); an inverter 103 for controlling the electric swing motor 14 based on a control signal output from the controller 13; and a relief valve 24.

As illustrated, the hydraulic line through which the hydraulic fluid discharged from the hydraulic pump 1 flows is connected to a center bypass hydraulic line 71 and to a meter-in hydraulic line 72 connected in parallel to the center bypass hydraulic line 71.

The center bypass line 71 extends such that it passes through the directional control valve 2 and the directional control valve 15 in the stated order and then returns to the tank 4. In other words, the center bypass line 71 connects the two directional control valves 2 and 15 in series.

The meter-in line 72 directs the hydraulic fluid discharged from the hydraulic pump 1 to each hydraulic actuator (the hydraulic swing motor 3 and the boom cylinder 16) through the directional control valves 2 and 15. In the present embodiment, the two directional control valves 2 and 15 (two hydraulic actuators) are connected in parallel.

Check valves 22 and 23 are located right upstream of the joint between the meter-in line 72 and the directional control valve 2 and the joint between the meter-in line 72 and the directional control valve 15, respectively. The check valve 22 supplies the hydraulic fluid to the hydraulic swing motor 3 only when the discharge pressure of the hydraulic pump 1 (i.e., the pump pressure) is higher than the pressure on the side of the actuator 3 (i.e., the actuator pressure). Likewise, the check valve 23 supplies the hydraulic fluid to the boom cylinder 16 only when the discharge pressure of the hydraulic pump 1 is higher than the pressure on the side of the actuator 16.

When the upper swing structure 50 and the boom 61 are moved slowly (i.e., when the control levers 10 and 19 are tilted relatively slightly), the pump load resulting from a swing motion is smaller than the pump load resulting from boom raising. For this reason, the orifice area of the center bypass throttle of the directional control valve 15 (used for the control of the boom cylinder 16) is made smaller than that of the directional control valve 2 so that the pump pressure during boom raising can be increased.

The relief valve 24 is connected in parallel to the center bypass line 71 and the meter-in line 72 and used to direct the hydraulic fluid to the tank 4 when the pump pressure reaches the relief pressure.

The control lever 10 receives hydraulic fluid from a pilot pump (not illustrated), which is driven by the engine 51. The pilot pump receives the hydraulic fluid from the hydraulic fluid source 9 of FIG. 2. Using the control lever 10 reduces the pressure of the hydraulic fluid fed from the hydraulic fluid source 9 according to the amount of tilting and generates a pilot pressure in the hydraulic line corresponding to the direction of the tilting. The pilot pressure generated by the operation of the control lever 10 acts on the spool of the directional control valve 2, thereby changing the spool position of the directional control valve 2.

The pilot pressure output by means of the control lever 10 is detected by a pressure sensor 11 or 12, and the detected value is input to the controller 13.

After receiving the hydraulic fluid from the meter-in line 72, the directional control valve 2 supplies it to the hydraulic swing motor 3. The direction of the flow of the hydraulic fluid to the hydraulic swing motor 3 is determined according to the spool position of the directional control valve 2. When the hydraulic fluid returns from the hydraulic swing motor 3 to the directional control valve 2, it is directed back to the tank 4 through the directional control valve 2.

The hydraulic circuit for the hydraulic swing motor 3 includes two relief valves 5 and 6 and two make-up valves 7 and 8, located in the respective routes of the hydraulic fluid to the hydraulic swing motor 3. The relief valves 5 and 6 allow the hydraulic fluid to flow back to the tank 4 when it reaches the relief pressure; thus, they protect the circuit against abnormally high pressures resulting from the acceleration or deceleration of swing motion. The make-up valves 7 and 8 are used to suction the hydraulic fluid from the tank 4 when the hydraulic lines are short of the hydraulic fluid and the in-line pressure is lower than the tank pressure. The downstream side of the pair of relief valves 5 and 6 and the upstream side of the pair of the relief valves 7 and 8 are connected to a hydraulic line leading to the tank 4.

The electric swing motor 14 is coaxially connected to the hydraulic swing motor 3, and the inverter 103 controls the operation and braking of the electric swing motor 14. During a swing operation alone (when only the swing structure 50 is moved with the other actuators stopped), the upper swing structure 50 is driven by the composite force obtained from the hydraulic swing motor 3 and the electric swing motor 14. It should be noted that the electric swing motor 14 and the hydraulic swing motor 3 can instead be connected together via a certain mechanical mechanism as long as they are capable of driving the upper swing structure 50 of their common drive object.

Similar to the control lever 10, the control lever 19 also receives hydraulic fluid from the hydraulic fluid source 9 through the pilot pump. Using the control lever 19 reduces the pressure of the hydraulic fluid fed from the hydraulic fluid source 9 according to the amount of tilting and generates a pilot pressure in the hydraulic line corresponding to the direction of the tilting. The pilot pressure generated by the operation of the control lever 19 acts on the spool of the directional control valve 15, thereby changing the spool position of the directional control valve 15.

A pressure sensor 20 is installed in the hydraulic line in which a pilot pressure is generated when the boom 61 is raised with the use of the control lever 19 (i.e., when the boom cylinder 16 is expanded). When the pressure sensor 20 detects the pilot pressure, it outputs the detected value to the controller 13.

After receiving the hydraulic fluid from the meter-in line 72, the directional control valve 15 supplies it to the boom cylinder 16. The direction of the flow of the hydraulic fluid to the boom cylinder 16 is determined according to the spool position of the directional control valve 15. For instance, when the control lever 19 is moved in the boom raising direction, the spool of the directional control valve 15 moves to the left side of FIG. 2, causing the hydraulic fluid to be fed from the pump 1 to the bottom hydraulic chamber of the boom cylinder 16. When the hydraulic fluid returns from the boom cylinder 16 to the directional control valve 15, it is directed back to the tank 4 through the directional control valve 15.

The shut-off valve 25 is a hydraulic pilot valve and located upstream of the check valve 22 in the meter-in line 72 connecting the hydraulic pump 1 and the directional control valve 2. When the shut-off valve 25 is in the closed position (described later), the supply of the hydraulic fluid from the meter-in line 72 to the directional control valve 2 is blocked, and so is the supply to the hydraulic swing motor 3 located downstream of the directional control valve 2.

The solenoid valve 26 is used to generate a pilot pressure for controlling the shut-off valve 25 and is controlled by an electric signal output from the controller 13. When no electric signal is output from the controller 13, the solenoid valve 26 stays in the position shown in FIG. 2 (i.e., OFF position), and the pilot pressure for the shut-off valve 25 is maintained at the tank pressure. In this case, the shut-off valve 25 is in the open position shown in FIG. 2. On the other hands, when an electric signal is output from the controller 13, the solenoid valve 26 is moved in the upper direction of FIG. 2 (i.e., placed in the ON position), causing the pilot pressure output of the pilot pump to act on the shut-off valve 25 through the hydraulic fluid source 9. This in turn causes the shut-off valve 25 to move to the right side of FIG. 2, whereby the shut-off valve 25 is placed in the closed position.

The controller 13 determines whether a swing operation caused by the control lever 10 and a boom raising operation caused by the control lever 19 are concurrent or not. If so, the controller 13 outputs an electric signal to the solenoid valve 26. As stated already, the controller 13 determines the presence or absence of a swing operation based on the output values from the pressure sensors 11 and 12 and the presence or absence of a boom raising operation based on the output value from the pressure sensor 20. The above determinations can be made by, for instance, using as a threshold the output value corresponding to the lowest value of pilot pressures generated by the operation of the control levers 10 and 19 by the operator (e.g., using a threshold of 1.0 MPa) and examining whether output values from the sensors 11, 12, and 20 are higher than the threshold.

After determining that a swing operation and a boom raising operation by the operator are concurrent, the controller 13 outputs an electric signal, thereby placing the solenoid valve 26 in the ON position and the shut-off valve 25 in the closed position. This causes the shut-off valve 25 to block the hydraulic fluid flowing from the hydraulic pump 1 before it reaches the directional control valve 2. As a result, while the boom 61 is being raised (i.e., while the boom cylinder 16 is being expanded), only the electric swing motor 14 is used to swing the upper swing structure 50. When, on the other hand, the controller 13 does not detect a concurrence of a swing operation and a boom raising operation, the solenoid valve 26 is kept in the OFF position and the shut-off valve 25 in the open position. This allows the hydraulic fluid from the hydraulic pump 1 to flow through the meter-in line 72 and the directional control valve 2 into the hydraulic swing motor 3.

The controller 13 also outputs to the inverter 103 a control signal that the inverter 103 uses to control the electric swing motor 14, so that the upper swing structure 50 swings according to the operation direction and amount of the control lever 10 (i.e., output values from the pressure sensors 11 and 12) regardless of a concurrence of a swing operation and a boom raising operation. On the basis of the control signal output from the controller 13, the inverter 103 controls the electric swing motor 14. The control of the electric swing motor 14 by the controller 13 and the inverter 103 can be achieved by a known method. For example, in order that the swing speed of the upper swing structure 50 can approach the target speed determined by the operation amount of the control lever 10, feedback control can be performed on the electric motor 14, thereby compensating for the insufficient torque of the hydraulic motor 3. In addition, the proportion of the torque obtained from the electric motor 14 to the torque obtained from the hydraulic motor 3 can be changed in an appropriate manner so that the target torque calculated from the operation amount of the control lever 10 can be obtained from the two motors 14 and 3. In the present embodiment, the hydraulic swing motor 3 does not output a torque when a swing operation and a boom raising operation are performed at the same time. Thus, by the electric swing motor 14 compensating for the loss of the torque, the maneuvering feelings resulting from the hydraulic circuit and control of the present embodiment, in which the hydraulic motor 3 and the electric motor 14 are used to drive the swing structure 50, are substantially the same as those resulting from a conventional hydraulic circuit in which only a hydraulic motor is used to drive a swing structure.

To clarify the advantageous effects achieved by the invention, a conventional hydraulic excavator will now be described. Since the hydraulic system of FIG. 2 is of an open-center type, a description is made of a conventional open-center hydraulic system. A directional control valve used in such a system includes a center bypass opening leading to a tank; a meter-in opening through which hydraulic fluid is directed to an actuator; and a meter-out opening through which the hydraulic fluid passes after returning from the actuator.

When the directional control valve is moved from its neutral position by its associated control lever being operated, the meter-in opening is opened, allowing the hydraulic fluid to flow to the actuator. When the valve is moved from the neutral position, the meter-out opening is also opened, directing the hydraulic fluid from the actuator back to the tank.

Moving the directional control valve from the neutral position also reduces the area of the center bypass opening. This increases the differential pressure of the hydraulic fluid across the center bypass opening, thus increasing the discharge pressure of the hydraulic pump. When the pump pressure exceeds the pressure required for the driving of the hydraulic actuator (i.e., the actuator load), the hydraulic fluid from the hydraulic pump beings to flow into the actuator, thereby driving the actuator. The area of the center bypass opening determines the ratio of the hydraulic fluid flowing into the hydraulic actuator to that flowing into the center bypass during the flow of the hydraulic fluid from the hydraulic pump into the actuator; thus, it controls the operational speed of the actuator as well.

As above, the area of the center bypass opening of a directional control valve is set optimally according to the load acting on an actuator and the actuator speed determined by the operation amount of the control lever (i.e., the pilot pressure).

For instance, the area of the center bypass opening of the directional control valve used for swing motion is made relatively large. When the operator slightly tilts the control lever to cause a swing motion, it means that he is requesting a low-speed swing motion. Also, the load required to slowly swing the upper swing structure of the hydraulic excavator (i.e., to cause a constant-speed swing motion) is not high. Thus, in this case, the necessity of increasing the pump pressure is low, and the area of the center bypass opening of the directional control valve used for swing motion is made relatively large.

In contrast, the area of the center bypass opening of the directional control valve used for boom raising is made relatively small. When the operator slightly tilts the control lever to raise the boom, it means that he is requesting low-speed boom raising. However, because a load is exerted on the bucket during load-lifting, the boom load is also high. Thus, to drive the boom, the pump pressure needs to be increased. Accordingly, for the purpose of supplying the hydraulic fluid to the boom cylinder, the area of the center bypass opening for boom raising is made relatively small.

As discussed above, even with the same lever operation amount, the optimal center bypass opening that ensures the compatibility between maneuverability and efficiency varies according to the load or speed of actuators. Generally, in a hydraulic system mounted in a hydraulic excavator or the like, the hydraulic fluid discharged from one hydraulic pump is distributed by directional control valves for the purpose of driving multiple hydraulic actuators. In the above open-center system, the center bypass lines of the directional control valves are connected in series, and the composite center bypass opening of the multiple actuators determines the pump pressure and the flow rate of the hydraulic fluid fed to actuators.

Figure 3:
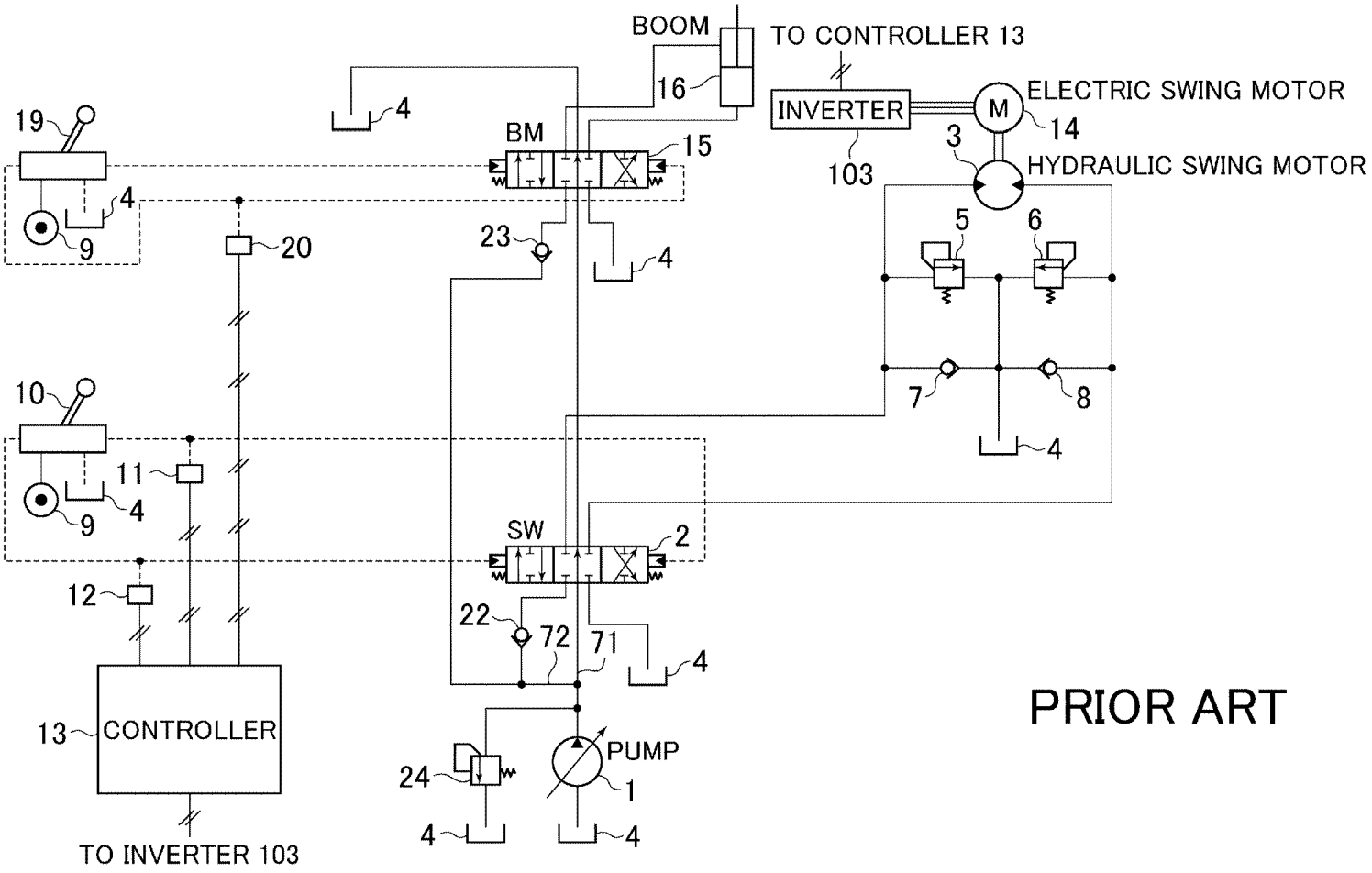
FIG. 3 is a schematic illustrating the overall structure of a hydraulic system in a hydraulic excavator according to a comparative example.

FIG. 3 is a schematic illustrating the overall structure of a hydraulic system in a hydraulic excavator according to a comparative example. The hydraulic system of FIG. 3 does not have the shut-off valve 25 and the solenoid valve 26 used in the hydraulic system 100 of FIG. 2. In the system of this comparative example, the upper swing structure 50 is driven by both the hydraulic swing motor 3 and the electric swing motor 14 at the time of a concurrence of a swing operation and a boom raising operation.

As in the open-center hydraulic system of FIG. 3, when the directional control valve 2 used to control swing motion and the directional control valve 15 used to control the boom are disposed along the same line, the following phenomenon will result, which is described below on the assumption that load-lifting work is performed.

Assume first that the operator is trying to lift a load slowly by performing a single operation of boom raising. Because the center bypass opening of the directional control valve 15 pertaining to the operation of the boom is closed so as to supply the hydraulic fluid to the boom cylinder 16 even at the time of a high load, the boom cylinder 16 is expanded to lift the load. Once the load is lifted up to the target height, the operator stops the boom raising operation.

Assume next that the operator is trying to move the load slowly by performing a single operation for swing. Even when the load is being lifted, the swing load is not high. Thus, the area of the center bypass opening of the directional control valve 2 pertaining to swing motion is larger than that of the directional control valve 15 pertaining to the operation of the boom, and the swing structure 50 swings slowly. That is, during load lifting, the areas of the center bypass openings of the directional control valves 2 and 15 are optimally set as long as a swing operation and a boom raising operation are not performed concurrently. Accordingly, the pump pressure and the flow rate of the hydraulic fluid into the hydraulic actuators 16 and 3 are controlled without any problem.

Assume now that the operator is trying to move the load in an obliquely upward direction while performing a swing operation. That is, the operator wants to perform a boom raising operation while performing a swing operation. Since the swing-related directional control valve 2 and the boom-related directional control valve 15 are disposed along the same pump line, the center bypass opening closed by a boom raising operation acts also as the center bypass opening for a swing operation. That is, the swing-related center bypass is closed, changing the balance between the center bypass flow rate and the swing-related meter-in flow rate. In addition, since the boom raising load is higher than the swing load, the hydraulic fluid tends to flow into the swing-related circuit. Thus, the hydraulic fluid may flow into the hydraulic swing motor 3, accelerating the swing motion against the will of the operator. The accelerated swing motion that does not reflect the actual operation by the operator may swing the load during the load lifting, which is not desirable.

In the hydraulic excavator of Embodiment 1, by contrast, such unwanted acceleration of swing motion is prevented because the shut-off valve 25 prevents the hydraulic fluid from flowing into the hydraulic swing motor 3 even if the pump pressure is increased at the time of a concurrence of a swing operation and a boom raising operation. Thus, the maneuvering feelings of the operator will not differ regardless of a concurrence of a swing operation and a boom raising operation. This allows the operator to easily stop the bucket 65 at the target position especially during a low-speed swing motion.

As stated above, in Embodiment 1, not the hydraulic swing motor 3 but the electric swing motor 14 is used to swing the upper swing structure 50 at the time of a concurrence of a swing motion and a boom raising operation. Thus, the hydraulic swing motor 3 is rotated by the electric swing motor 14. In this case, either the make-up valve 7 or 8 is used to suction the hydraulic fluid from the tank 4 into the entrance of the hydraulic swing motor 3, and the directional control valve 2 is used to discharge the hydraulic fluid from the exit of the hydraulic swing motor 3 to the tank 4.

Figure 4:
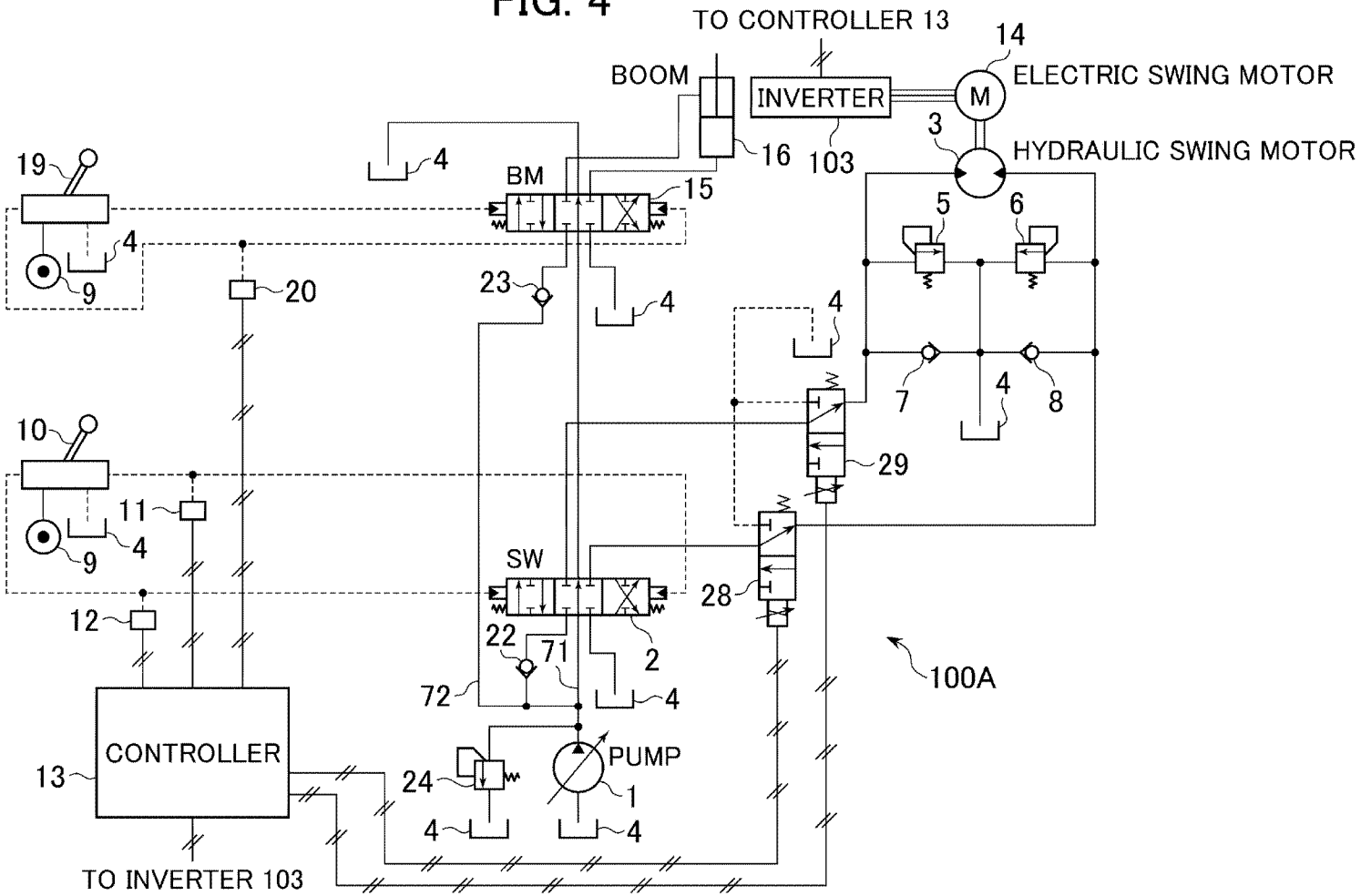
FIG. 4 is a schematic illustrating the overall structure of a hydraulic system 100A according to Embodiment 2 of the invention.

FIG. 4 is a schematic illustrating the overall structure of a hydraulic system 100A according to Embodiment 2 of the invention. In the present embodiment, as means for blocking the flow of hydraulic fluid into the hydraulic swing motor 3, solenoid shut-off valves 28 and 29 are installed in the two hydraulic lines connecting the directional control valve 2 and the hydraulic swing motor 3. The solenoid valves 28 and 29 are located upstream of the hydraulic swing motor 3, the make-up valves 7 and 8, and the relief valves 5 and 6.

The solenoid valves 28 and 29 are controlled on the basis of an electric signal output from the controller 13. In the absence of an electric signal from the controller 13, the solenoid valves 28 and 29 stay in the position shown in FIG. 4 (i.e., OFF or open position), maintaining the communication between the directional control valve 2 and the hydraulic motor 3. In the presence of an electric signal from the controller 13, the solenoid valves 28 and 29 move in the upper direction of FIG. 4 (i.e., to the ON or closed position), thereby blocking the hydraulic lines extending from the directional control valve 2 and connecting the hydraulic lines extending from the hydraulic swing motor 3 to the tank 4. This allows the solenoid valves 28 and 29 to block the supply of the hydraulic fluid from the hydraulic pump 1 to the hydraulic motor 3. In this case, the suctioning of the hydraulic fluid by the hydraulic motor 3 driven by the electric motor 14 is performed through the make-up valve 8 or 7 or the solenoid valve 28 or 29 blocking the flow of the hydraulic fluid from the hydraulic pump 1.

In the above hydraulic system 100A, when the controller 13 determines that the operator has concurrently performed a swing operation and a boom raising operation, it outputs an electric signal to place the solenoid valves 28 and 29 in the ON position. This allows the solenoid valve 28 or 29 to block the flow of the hydraulic fluid from the hydraulic pump 1 before the hydraulic fluid reaches the hydraulic motor 3. On the other hand, when the controller 13 does not detect a concurrence of a swing operation and a boom raising operation, it does not output an electric signal to the solenoid valves 28 and 29. Thus, the solenoid valves 28 and 29 are kept in the OFF position. This allows the hydraulic fluid from the hydraulic pump 1 to flow through the meter-in line 72 and the direction control valve 2 into the hydraulic swing motor 3.

In the present embodiment as well, even if the pump pressure is increased during a concurrence of a swing operation and a boom raising operation, the hydraulic fluid from the hydraulic pump 1 does not flow into the hydraulic motor 3, thus leading to advantageous effects similar to those obtained from Embodiment 1.

It should be note that while we have stated that the two solenoid valves 28 and 29 are placed in the ON position at the time of a concurrence of a swing operation and a boom raising operation, it is instead possible to place only the solenoid valve corresponding to the swing direction requested by the control lever 10 in the ON position. The reason is that, in this case, the hydraulic fluid returning from the hydraulic motor 3 is directed back to the tank 4 through the other solenoid valve placed in the OFF position and the directional control valve 2. For instance, when the control lever 10 is operated in the direction in which the value detected by the pressure sensor 11 increases, the hydraulic fluid flows to the solenoid valve 28. In this case, only the solenoid valve 28 can be placed in the ON position, keeping the solenoid valve 29 in the OFF position.

Figure 5:
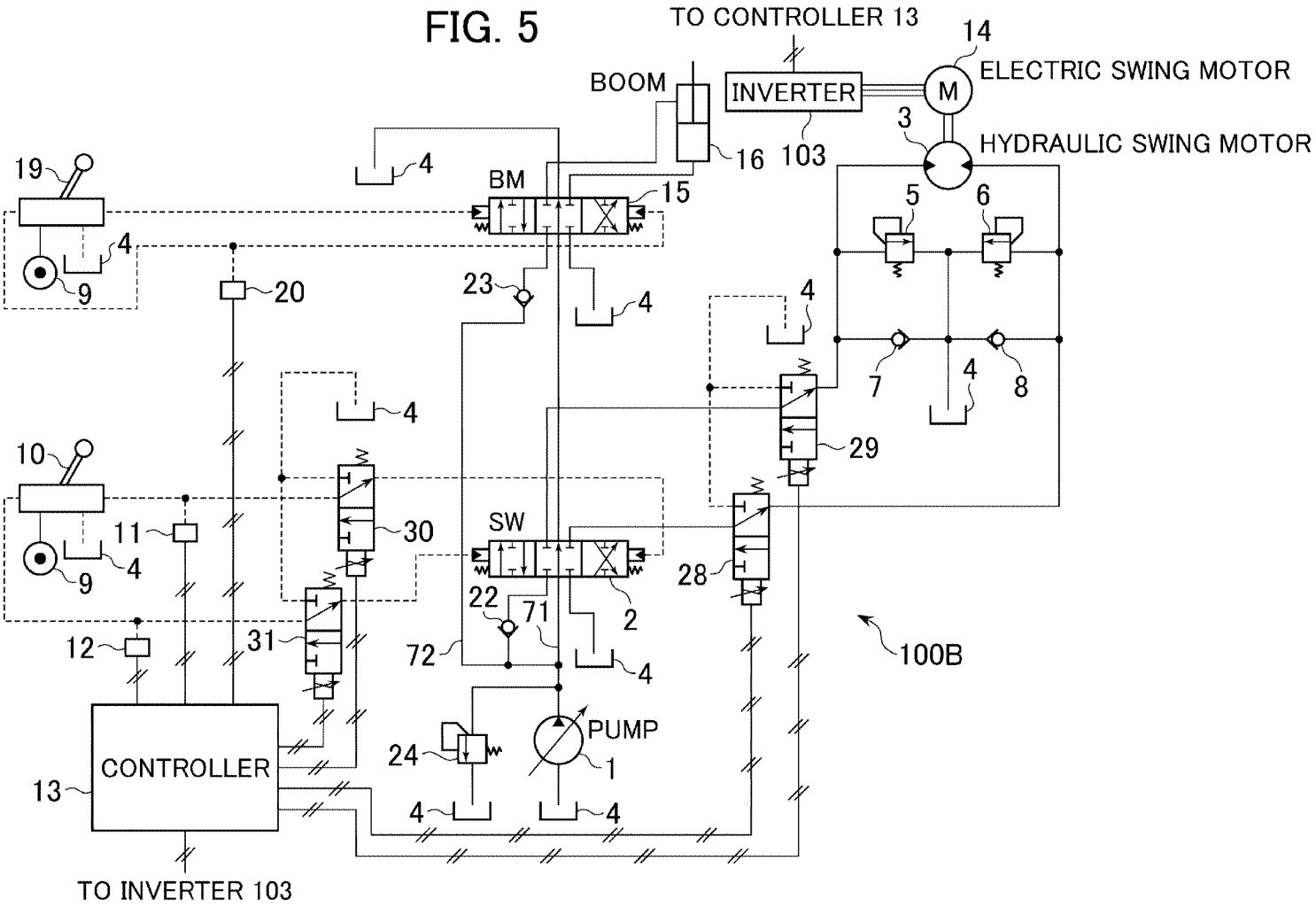
FIG. 5 is a schematic illustrating the overall structure of a hydraulic system 100B according to Embodiment 3 of the invention.

FIG. 5 is a schematic illustrating the overall structure of a hydraulic system 100B according to Embodiment 3 of the invention. In this embodiment, the system includes solenoid shut-off valves 30 and 31 as blocking devices for blocking a pilot pressure (control signal) acting on the directional control valve 2. The solenoid valves 30 and 31 block the flow of hydraulic fluid into the hydraulic swing motor 3 at the time of a concurrence of a swing operation and a boom raising operation.

The solenoid valves 30 and 31 are controlled on the basis of an electric signal output from the controller 13. In the absence of an electric signal from the controller 13, the solenoid valves 30 and 31 stay in the position shown in FIG. 5 (i.e., OFF or open position), and a pilot pressure generated by the operation of the control lever 10 acts on the directional control valve 2. In the presence of an electric signal from the controller 13, the solenoid valves 30 and 31 moves in the upper direction of FIG. 5 (i.e., to the ON or closed position), and the pilot pressure generated by the operation of the control lever 10 is prevented from acting on the directional control valve 2. This allows the directional control valve 2 to stay in the neutral position, blocking the flow of the hydraulic fluid from the hydraulic pump 1 to the hydraulic motor 3.

In the above hydraulic system 100B, when the controller 13 determines that the operator has concurrently performed a swing operation and a boom raising operation, it outputs an electric signal, thereby placing the four solenoid valves 28, 29, 30, and 31 in the ON position. Among the four solenoid valves, the solenoid valves 30 and 31 block the pilot pressure (control signal) acting on the directional control valve 2; thus, the directional control valve 2 stays in the neutral position. Accordingly, the hydraulic fluid is prevented from flowing from the hydraulic pump 1 to the hydraulic motor 3. The rest of the solenoid valves, 28 and 29, connect the hydraulic swing motor 3 to the tank 4. Thus, the suctioning of the hydraulic fluid by the hydraulic motor 3 rotated by the electric motor 14 at the time of a concurrence of a swing operation and a boom raising operation is performed through the make-up valve 8 or 7, and the discharge of the hydraulic fluid is done through the solenoid valve 28 or 29 (the returning fluid is eventually directed back to the tank 4).

When, on the other hand, the controller 13 does not detect a concurrence of a swing operation and a boom raising operation, it does not output an electric signal to the solenoid valves 28, 29, 30 and 31. Thus, the solenoid valves 28, 29, 30, and 31 are kept in the OFF position. This allows the hydraulic fluid from the hydraulic pump 1 to flow through the direction control valve 2 into the hydraulic swing motor 3 according to the operation direction and amount of the control lever 10.

Thus, in Embodiment 3 as well, even if the pump pressure is increased during a concurrence of a swing operation and a boom raising operation, the hydraulic fluid from the hydraulic pump 1 does not flow into the hydraulic motor 3, thus leading to advantageous effects similar to those obtained from Embodiment 1. In Embodiment 2, although the hydraulic fluid from the hydraulic pump 1 does not flow to the hydraulic motor 3, the throttling loss of the directional control valve 2 increases owing to its restricted center bypass circuit. In Embodiment 3, by contrast, the boom cylinder 16 can be controlled with the center bypass opening suitable for boom raising since the center bypass of the directional control valve 2 is kept closed.

It should be noted that while we have stated that the four solenoid valves 28, 29, 30, and 31 are placed in the ON position at the time of a concurrence of a swing operation and a boom raising operation, it is instead possible to place only the two solenoid valves corresponding to the swing direction requested by the control lever 10 in the ON position. For instance, when the control lever 10 is operated in the direction in which the value detected by the pressure sensor 11 increases, the solenoid valves 30 and 29 can be placed in the ON position, keeping the solenoid valve 31 and 28 in the OFF position.

Figure 6:
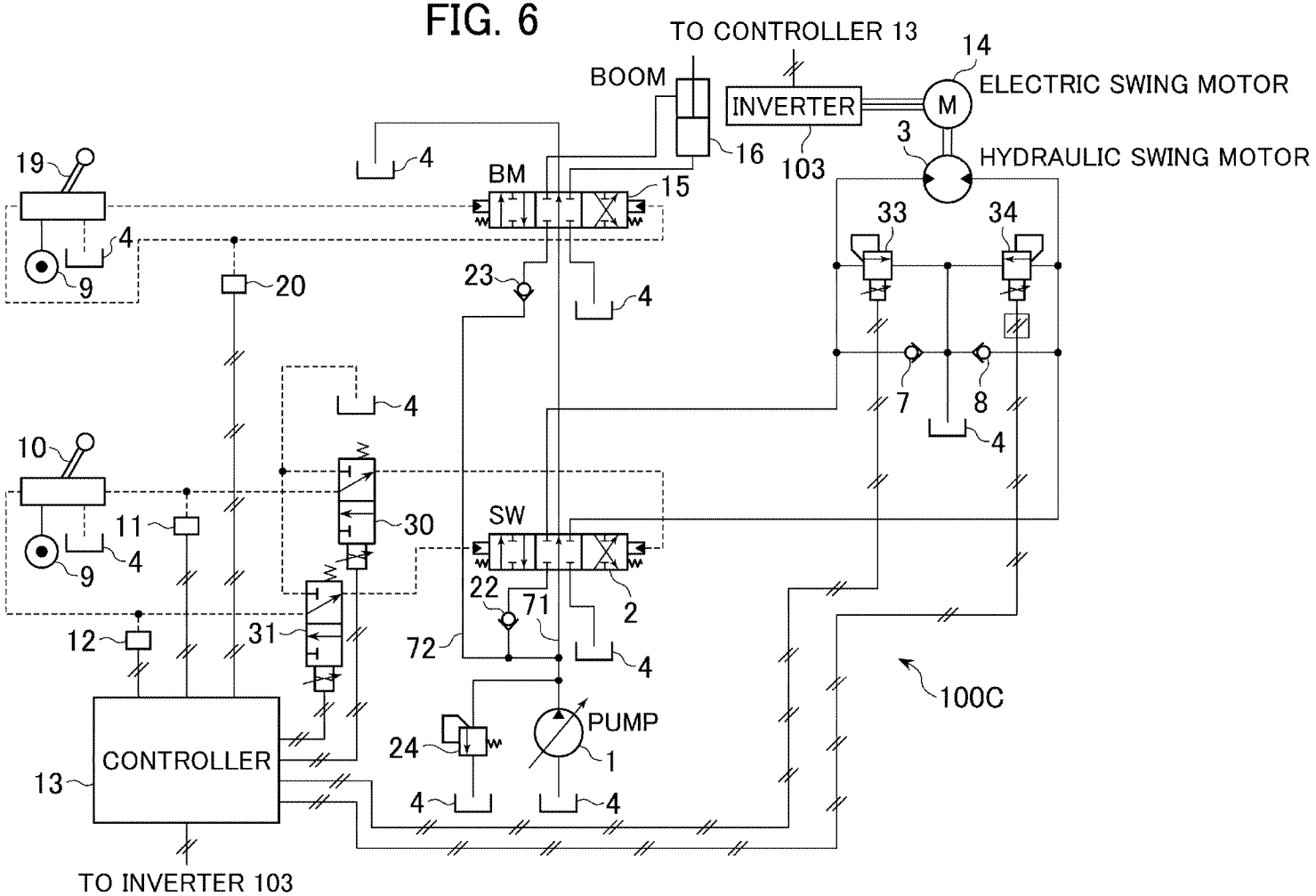
FIG. 6 is a schematic illustrating the overall structure of a hydraulic system 100C according to Embodiment 4 of the invention.

FIG. 6 is a schematic illustrating the overall structure of a hydraulic system 100C according to Embodiment 4 of the invention. While Embodiment 4 includes the solenoid valves 30 and 31 used in Embodiment 3 as means for blocking the flow of hydraulic fluid into the hydraulic swing motor 3, Embodiment 4 differs from Embodiment 3 in that Embodiment 4 further includes variable relief valves 33 and 34 as means for connecting the hydraulic motor 3 to the tank 4 at the time of a concurrence of a swing operation and a boom raising operation.

The variable relief valves 33 and 34 replace the relief valves 5 and 6 of the previous embodiments and are installed in the circuit of the hydraulic motor 3. The relief pressure can be changed as desired by a signal from the controller 13. When the controller 13 determines that the operator has concurrently performed a swing operation and a boom raising operation, the relief pressure of the variable relief valves 33 and 34 is reduced sufficiently by a signal from the controller 13 to the extent that the hydraulic fluid returning from the hydraulic motor 3 easily flows into the tank 4. In other situations, the relief pressure is set to the predetermined value used for the relief valves 5 and 6.

In the above hydraulic system 100C, when the controller 13 determines that the operator has concurrently performed a swing operation and a boom raising operation, it outputs an electric signal to place the two solenoid valves 30 and 31 in the ON position and reduce the relief pressure of the variable relief valves 33 and 34. This blocks the flow of the hydraulic fluid from the hydraulic pump 1 to the hydraulic motor 3. Also, the suctioning of the hydraulic fluid by the hydraulic motor 3 rotated by the electric motor 14 at the time of a concurrence of a swing operation and a boom raising operation is performed through the make-up valve 8 or 7, and the discharge of the hydraulic fluid is done through the variable relief valve 33 or 34. Thus, Embodiment 4 has advantageous effects similar to those obtained from Embodiment 3.

Figure 7:
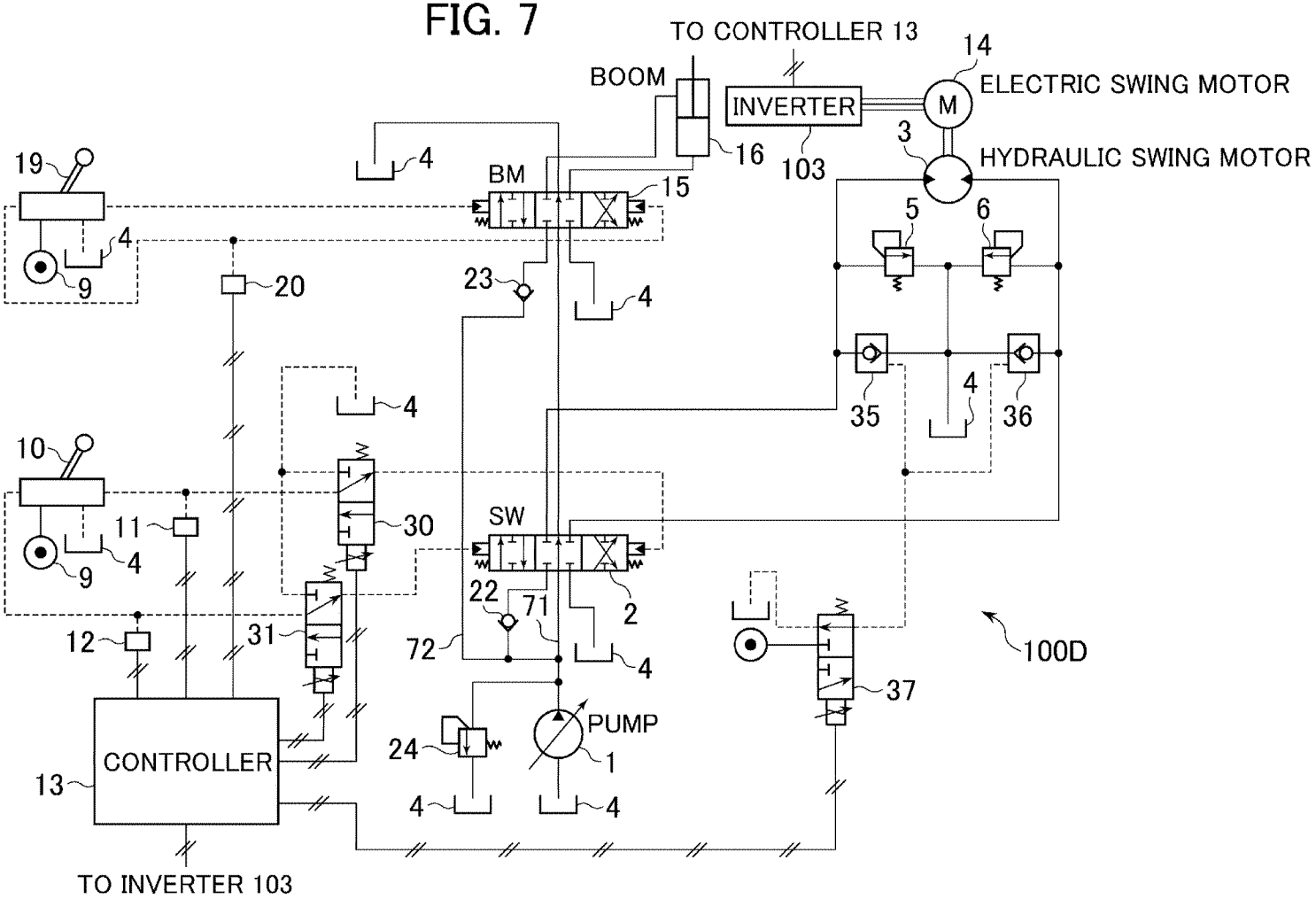
FIG. 7 is a schematic illustrating the overall structure of a hydraulic system 100D according to Embodiment 5 of the invention.

FIG. 7 is a schematic illustrating the overall structure of a hydraulic system 100D according to Embodiment 5 of the invention. While Embodiment 5 includes the solenoid valves 30 and 31 used in Embodiment 3 as means for blocking the flow of hydraulic fluid into the hydraulic swing motor 3, Embodiment 5 differs from Embodiment 3 in that Embodiment 5 further includes pilot check valves 35 and 36 as means for connecting the hydraulic motor 3 to the tank 4 at the time of a concurrence of a swing operation and a boom raising operation.

The two pilot check valves 35 and 36 replace the make-up valves 7 and 8 of the previous embodiments and are installed in the circuit of the hydraulic motor 3. The pilot check valves 35 and 36 can reverse the flow of hydraulic fluid using the pilot pressure output through a solenoid valve 37 in response to a signal from the controller 13.

The solenoid valve 37 moves to the upper position shown in FIG. 7 (i.e., the ON position) when it receives an electric signal from the controller 13. When the solenoid valve 37 is placed in the ON position, the pilot pressure output from the pilot pump through the hydraulic fluid source 9 acts on the two pilot check valves 35 and 36. This allows the hydraulic fluid to flow to the tank 4 through the pilot check valves 35 and 36. On the other hand, when the solenoid valve 37 does not receive an electric signal from the controller 13, it stays in the OFF position shown in FIG. 7, preventing the hydraulic fluid from flowing into the tank 4 through the pilot check valves 35 and 36.

In the above hydraulic system 100D, when the controller 13 determines that the operator has concurrently performed a swing operation and a boom raising operation, it outputs an electric signal to place the two solenoid valves 30 and 31 in the ON position and also place the solenoid valve 37 in the ON position. This blocks the flow of the hydraulic fluid from the hydraulic pump 1 to the hydraulic motor 3. Also, the pilot check valves 35 and 36 are opened by the pilot pressure output through the solenoid valve 37. Thus, the suctioning and discharge of the hydraulic fluid by the hydraulic motor 3 at the time of a concurrence of a swing operation and a boom raising operation are performed through the two pilot check valves 35 and 36. Thus, Embodiment 5 has advantageous effects similar to those obtained from Embodiment 3.

While we have described cases where a swing operation and a boom raising operation are concurrently performed, the application of the invention is not limited to such cases. The invention can also be applied to cases where a swing operation is performed together with an operation performed by actuators other than the boom cylinder 16. This is because the acceleration of swing motion (velocity change) during a concurrence of a swing operation and another operation, which is the problem addressed by the invention, occurs owing to an increase in the discharge pressure of the hydraulic pump.

Further, while we have described examples of the parallel circuit in which the hydraulic pump is connected to all the directional control valves, the invention can also be applied to systems in which more hydraulic fluid flows into the hydraulic swing motor when the hydraulic swing motor and another hydraulic actuator are operate together (in this case, a smaller load is exerted on the hydraulic swing motor than on the actuator). That is, the invention can also be applied to a tandem circuit in which the hydraulic swing motor is located upstream of other hydraulic actuators including the boom cylinder. In addition, the invention can be applied not only to cases where open-center directional control valves are used but to cases where closed-center directional control valves are used.

In the foregoing embodiments, the pilot pressure (pressure control signal) output from the control device 10 is detected by the pressure sensors 11 and 12 and converted into an electric signal, which is then output to the controller 13. However, it is instead possible to directly output an electric control signal corresponding to the operation amount of the control lever 10. In this case, a positional sensor (e.g., a rotary encoder) can be used to detect the rotational displacement of the control lever 10. Further, in the foregoing embodiments, the pilot pressure is exerted on the directional control valve 2 to control its spool position. However, it is also possible to replace the directional control valve 2 with a solenoid valve whose spool position is controlled by an electric signal. Moreover, while only the pressure sensors 11 and 12 are used to detect the operation amount of the control lever 10 in the foregoing embodiments, it is also possible to use the pressure sensors 11 and 12 together with a positional sensor or other sensor with a different detection mechanism. In this case, even if one sensor goes out of order, the other sensors can cover for the broken sensor, thus improving the reliability of the system.

The invention is not limited to the foregoing embodiments but allows various modifications without departing from the scope of the invention. For instance, the invention is not limited by systems that comprise all the components described in the above embodiments, but includes systems in which some of the components are absent. Further, certain components of an embodiment of the invention can be added to another embodiment of the invention or replaced by components of another embodiment of the invention.

DESCRIPTION OF THE REFERENCE NUMERALS

1: Pump
2: Swing directional control valve
3: Hydraulic swing motor
4: Tank
5: Relief valve
6: Relief valve
7: Make-up valve
8: Make-up valve
9: Hydraulic fluid source from pilot pump
10: Swing control lever
11: Swing pilot pressure sensor
12: Swing pilot pressure sensor
13: Controller
14: Electric swing motor
15: Boom directional control valve
16: Boom cylinder
17: Tank
19: Boom control lever
20: Pressure sensor
22: Check valve
23: Check valve
24: Relief valve
25: Shut-off valve
26: Solenoid valve
28: Solenoid valve
29: Solenoid valve
30: Solenoid valve
31: Solenoid valve
33: Variable relief valve
34: Variable relief valve

35: Pilot check valve
36: Pilot check valve
37: Solenoid valve
50: Upper swing structure
61: Boom

The invention claimed is:

1. A construction machine comprising:

a swing structure;

a hydraulic pump;

a hydraulic motor to drive the swing structure using hydraulic fluid from the hydraulic pump;

an electric motor to drive the swing structure with or without the aid of the hydraulic motor;

a hydraulic actuator driven by the hydraulic fluid from the hydraulic pump, the hydraulic actuator configured to operate together with the swing structure;

a first directional control valve for controlling a direction and flow rate of the hydraulic fluid supplied to the hydraulic motor;

a second directional control valve for controlling a direction and flow rate of the hydraulic fluid supplied to the hydraulic actuator;

a meter-in hydraulic line that directs the hydraulic fluid discharged from the hydraulic pump to each of the hydraulic motor and the hydraulic actuator through the first and second directional control valves;

a first control lever to output a control signal to control a swing motion of the swing structure, a second control lever to output a control signal to control a motion of the hydraulic actuator;

first sensors to detect a presence or absence of an operation of the first control lever;

a second sensor to detect a presence or absence of an operation of the second control lever; and a controller configured to control an operation of the swing structure, wherein the first directional control valve and the second directional control valve are connected in parallel on the meter-in hydraulic line, and wherein when the controller determines that the swing structure is operated together with the hydraulic actuator on the basis of input signals from the first sensors and second sensor, the controller cuts off the hydraulic fluid supplied from the hydraulic pump to the hydraulic motor and swings the swing structure only with the electric motor.

2. The construction machine of claim 1, further comprising:

a shut-off valve installed in the meter-in hydraulic line connecting the hydraulic pump and the first directional control valve, wherein the shut-off valve is placed in a closed position when the swing structure is operated together with the hydraulic actuator.

3. The construction machine claim 1, further comprising:

shut-off valves installed in hydraulic lines connecting the first directional control valve and the hydraulic motor, wherein the shut-off valves are placed in a closed position when the swing structure is operated together with the hydraulic actuator.

4. The construction machine of claim 1, further comprising:

blocking devices configured to block a control signal acting on the first directional control valve when the swing structure is operated together with the hydraulic actuator.

* * * * *